US008057027B2

(12) United States Patent
Kanbe

(10) Patent No.: US 8,057,027 B2
(45) Date of Patent: Nov. 15, 2011

(54) INK CARTRIDGES

(75) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 402 days.

(21) Appl. No.: 12/391,985

(22) Filed: Feb. 24, 2009

(65) Prior Publication Data

US 2009/0219355 A1 Sep. 3, 2009

(30) Foreign Application Priority Data

Feb. 29, 2008 (JP) ..... 2008-051354

(51) Int. Cl.
*B41J 2/175* (2006.01)

(52) U.S. Cl. ..... 347/86

(58) Field of Classification Search ..... 347/81, 347/86, 87

See application file for complete search history.

(56) References Cited

U.S. PATENT DOCUMENTS

| | | | | |
|---|---|---|---|---|
| 7,246,894 | B2 | 7/2007 | Hattori et al. | |
| 7,325,913 | B2 * | 2/2008 | Sasaki et al. | 347/86 |
| 2006/0033789 | A1 | 2/2006 | Sasaki et al. | |

FOREIGN PATENT DOCUMENTS

| | | | |
|---|---|---|---|
| JP | 2005-262564 | A | 9/2005 |
| JP | 2007-144805 | A | 6/2007 |

* cited by examiner

*Primary Examiner* — An Do
(74) *Attorney, Agent, or Firm* — Baker Botts L.L.P.

(57) ABSTRACT

An ink cartridge has a case having an ink chamber defined therein, and a pivotable member positioned in the ink chamber. The pivotable member has an opening formed therethrough, and the pivotable member pivots about the opening of the pivotable member. The ink cartridge also has a supporting shaft having a first end and a second end opposite the first end. The supporting shaft is positioned within the opening of the pivotable member. The ink cartridge further has a supporting member that supports at least one of the first end and the second end of the supporting shaft, and a projection extending from the supporting member toward the pivotable member.

14 Claims, 8 Drawing Sheets

INK CARTRIDGES

CROSS-REFERENCE TO RELATED APPLICATION

The present application claims priority from Japanese Patent Application No. JP-2008-51354, which was filed on Feb. 29, 2008, the disclosure of which is incorporated herein by reference in its entirety.

BACKGROUND OF THE INVENTION

1. Field of the Invention

The invention relates generally to ink cartridges, and more specifically, to ink cartridges comprising a pivotable member configured to pivot about a supporting shaft in an ink chamber.

2. Description of Related Art

A known image printing apparatus is configured to print an image on a sheet of paper with ink. The known image printing apparatus has an inkjet type print head, and selectively ejects ink droplets from nozzles of the print head toward the sheet of paper to print an image on the sheet of paper. A known ink cartridge is configured to be removably mounted to the known image printing apparatus, and the ink cartridge is configured to store ink therein and to supply the ink to the print head. When the known ink cartridge becomes empty of ink, the ink cartridge is removed from the image printing apparatus, and a new ink cartridge is mounted to the image printing apparatus. In order to determine the timing of replacement of the ink cartridge, a known detector is configured to detect the remaining amount of ink in the ink cartridge.

In a known ink cartridge, such as the ink cartridge described in JP-A-2005-262564, a float is configured to move in an ink chamber. The float is positioned at one end of a connecting member, and a light-blocking panel is positioned at the other end of the connecting member. A shaft is integrally positioned at the connecting member between the float and the light-blocking panel. The shaft is supported by a supporting base positioned at the bottom of the ink chamber, such that the connecting member is pivotable about the shaft in the ink chamber. The float is configured to move with buoyancy in accordance with the amount of ink in the ink chamber. The connecting member is configured to pivot according to the movement of the float, and the position of the light-blocking panel changes when the connecting member pivots. By optically detecting the change of the position of the light-blocking panel, the amount of ink in the ink chamber is determined.

In a known ink cartridge, the connecting member is manufactured by molding synthetic resin, the weight of which can be reduced to reduce frictional resistance when a connecting member pivots. Moreover, the shaft of the connecting member has a smaller diameter in order to reduce the frictional resistance with respect to the supporting base. Nevertheless, when the connecting member and the shaft are integrally formed of the synthetic resin, the smaller the diameter of the shaft is, the more difficult it becomes to center the center axis of the shaft. Because the molded product made of synthetic resin is subjected to burrs or steps generated by a parting line, it is difficult to smooth the peripheral surface of the shaft.

When the shaft is not integrally manufactured with the connecting member, the number of components increases in a supporting mechanism of the connecting member, and the shaft cannot be supported accurately at a predetermined position due to factors, such as imperfections due to a cumulative effect of the dimensional tolerances of the respective components, or positional displacements of supporting portions. Thus, the pivotal movement of the connecting member is hindered. Moreover, if the rattling of the connecting member with respect to the supporting mechanism is increased, the connecting member is easily tilted when the rattling increases, which may prevent the connecting member from pivoting smoothly. For example, the pivotal movement of the connecting member may be hindered when the connecting member contacts other members of the ink cartridge such as the inner wall of the ink chamber, or the connecting member may be stuck to the inner wall due to the surface tension of ink.

SUMMARY OF THE INVENTION

Therefore, a need has arisen for ink cartridges which overcome these and other shortcomings of the related art. A technical advantage of the invention is that pivotal movement of a pivotable member in an ink chamber is smoothed.

According to an embodiment of the invention, an ink cartridge comprises a case having an ink chamber defined therein, a pivotable member positioned in the ink chamber, wherein the pivotable member has an opening formed therethrough, and the pivotable member is configured to pivot about the opening of the pivotable member, a supporting shaft comprising a first end and a second end opposite the first end, wherein the supporting shaft is positioned within the opening of the pivotable member, a supporting member configured to support at least one of the first end and the second end of the supporting shaft, and a projection extending from the supporting member toward the pivotable member.

BRIEF DESCRIPTION OF DRAWINGS

For a more complete understanding of the invention, the needs satisfied thereby, and the objects, features, and advantages thereof, reference now is made to the following description taken in connection with the accompanying drawings.

DETAILED DESCRIPTION OF EMBODIMENTS

Exemplary embodiments of the present invention may be understood by referring to FIGS. 1-8, like numerals being used for like corresponding parts in the various drawings.

Figure 1:
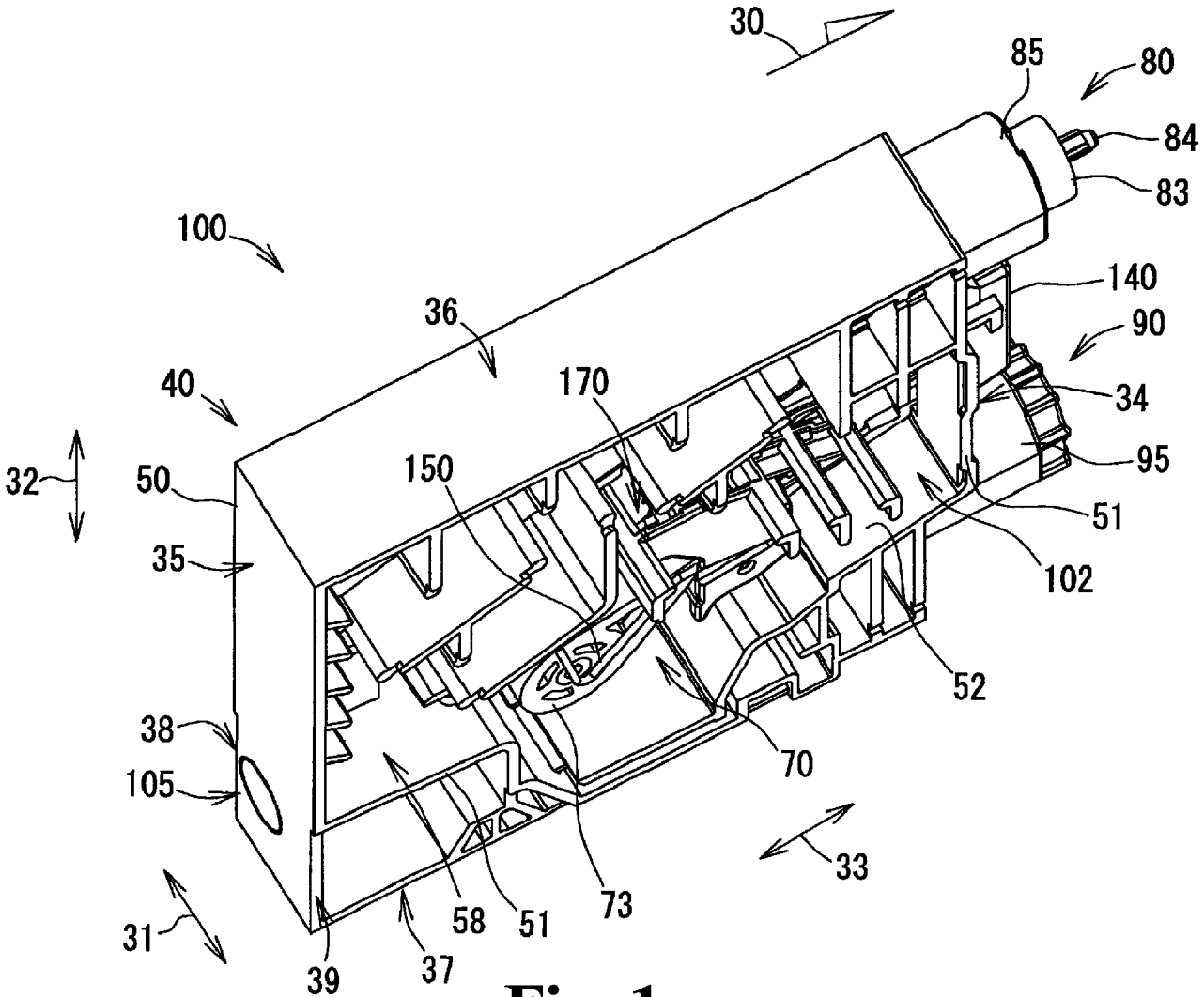
FIG. 1 is a perspective view of an ink cartridge according to an embodiment of the invention.
Figure 2:
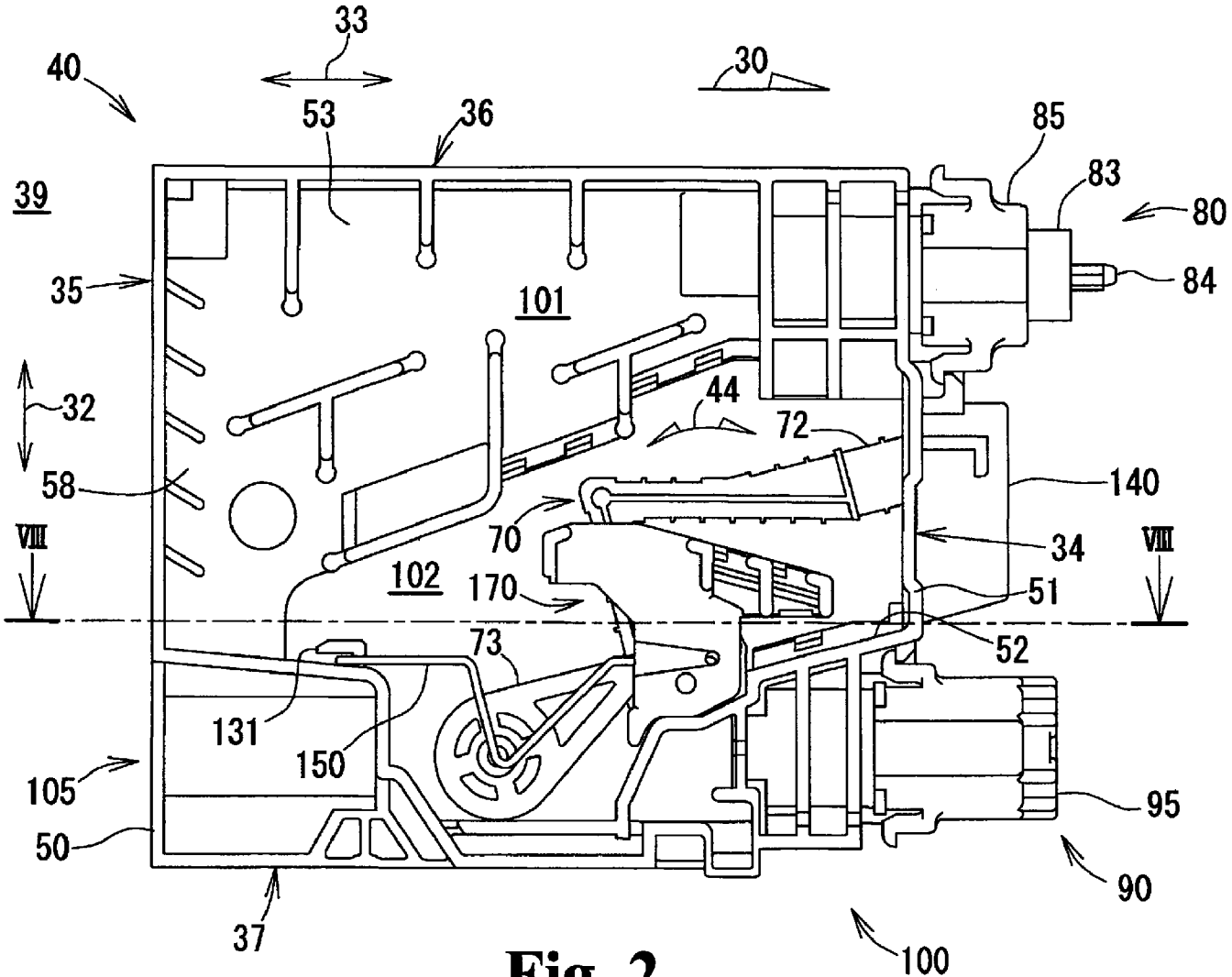
FIG. 2 is a right side view of ink cartridge of FIG. 1.
Figure 3:
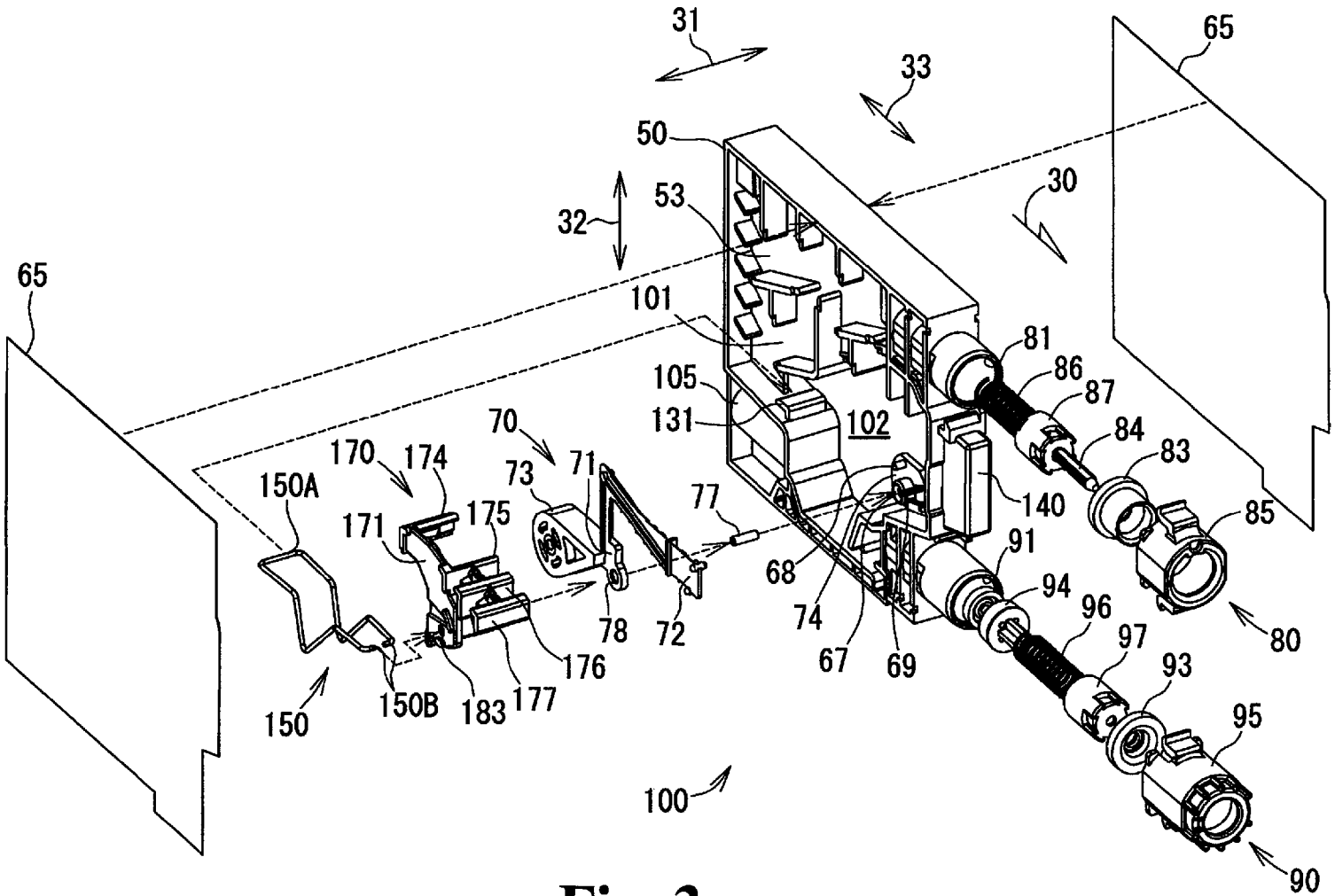
FIG. 3 is an exploded perspective view of the ink cartridge of FIG. 1.

FIGS. 1-3 describe an ink cartridge 100 according to an embodiment of the invention. Ink cartridge 100 may be used with an image printing apparatus, e.g., an inkjet printer. Ink cartridge 100 may have a substantially flat hexahedron shape. More specifically, ink cartridge 100 may have a substantially rectangular parallelepiped shape having a width in a width direction 31, a height in a height direction 32, and a depth in a depth direction 33. Each of the height and the depth of ink cartridge 100 may be greater than the width of ink cartridge 100. Ink cartridge 100 may be inserted into a mounting portion (not shown) of the image printing apparatus, in an insertion direction 30, while being in an upright position as shown in FIG. 1.

Referring to FIGS. 1 and 3, Ink cartridge 100 may comprise a front face 34, a rear face 35 opposite front face 34, an upper face 36, a lower face 37 opposite upper face 36, a left side face 38, and a right side face 39 opposite left side face 38. An area of left side face 38 and right side face 39 may be greater than an area of each of front face 34, rear face 35, upper face 36, and lower face 37. In this embodiment, the respective faces 34-39 may not only comprise planes, but also may comprise an entire surface of ink cartridge 100 which appears in a view when the respective faces 34-39 are seen in a front view, respectively.

Referring to FIGS. 1 and 2, Ink cartridge 100 may comprise a case 40, an air communication valve 80, an ink supply valve 90, a pivotable member 70, a supporting block 170, and a protecting member 150. Protecting member 150 may comprise a wire spring, which may comprise steel material, e.g., stainless steel. Case 40, air communication valve 80, ink supply valve 90, pivotable member 70, and a supporting block 170 may comprise resin material. In another embodiment, ink cartridge 100 may comprise another case which may substantially enclose case 40 entirely. In yet another embodiment, ink cartridge 100 may comprise a protector, which may cover ink supply valve 90.

Referring to FIG. 3, case 40 may comprise a frame 50 and one or more films 65. Frame 50 may comprise six faces 34-39 of ink cartridge 100. Therefore, six faces 34-39 of ink cartridge 100 may correspond to six faces of frame 50. In the following description, the respective faces of frame 50 will be indicated by reference numerals 34-39, which may designate the respective faces of ink cartridge 100.

Frame 50 may comprise a translucent, e.g., a transparent or semi-transparent, synthetic resin. Frame 50 may be manufactured by injection-molding the synthetic resin, e.g., polyacetal, nylon, polyethylene, polypropylene, and a combination thereof.

Referring to FIGS. 1 and 2, frame 50 may comprise an outer peripheral wall 51. Outer peripheral wall 51 may extend from left side face 38 to right side face 39. Outer peripheral wall 51 may comprise a substantially rectangular perimeter along front face 34, upper face 36, rear face 35, and lower face 37, such that a space may be defined therein. Accordingly, a pair of openings 58 may be formed on left side face 38 and right side face 39 of frame 50. Left side face 38 and right side face 39 of frame 50 thus may be opened, respectively.

Frame 50 may comprise a partitioning panel 53 partitioning an upper portion of an ink chamber 101 at substantially the center of ink chamber 101 in width direction 31 of frame 50. Partitioning panel 53 may be integrally formed with outer peripheral wall 51. A space 102 may be formed at a lower portion of ink chamber 101, in which pivotable member 70 and supporting block 170 may be positioned. Therefore, space 102 may be continuous in width direction 31 of frame 50 and may extend from left side face 38 to right side face 39.

Referring to FIG. 3, each of films 65 may comprise a thin, transparent resin-film. Films 65 may be adhered to edges of frame 50 on both side faces 38, 39, e.g., to the edges of the outer peripheral wall 51 on side faces 38, 39 by a known thermal welding method, such that openings 58 may be closed by respective films 65. Accordingly, a space surrounded by outer peripheral wall 51 of frame 50 and films 65 may be defined as ink chamber 101 configured to store ink therein. Although ink chamber 101 is defined by frame 50 and films 65 in this embodiment, in another embodiment, ink chamber 101 may be formed in a frame having a parallelepiped container shape.

Referring to FIGS. 1-3, frame 50 may comprise an ink filling portion 105 at rear face 35. Ink filling portion 105 may be positioned slightly lower than a center portion of rear face 35. Ink may be filled into ink chamber 101 via ink filling portion 105. When filling ink cartridge 100 with ink, a filling method, e.g., decompression filling method or vacuum filling method, may be employed for increasing the amount of deaeration in ink chamber 101 in order to reduce or prevent generation of air bubbles in ink chamber 101. More specifically, air in the ink chamber 101 may be drawn and removed before ink chamber 101 is filled with ink, such that the pressure in ink chamber 101 is reduced to a pressure close to vacuum. Subsequently, ink chamber 101 may be filled with ink by using the pressure difference between an interior and an exterior of ink chamber 101. After ink chamber 101 is filled with ink, ink filling portion 105 may be sealed while the pressure in ink chamber 101 is kept at a pressure less than the atmospheric air pressure. Thus, ink chamber 101 of an unused ink cartridge 100 may be maintained at a pressure less than the atmospheric air pressure.

A translucent portion 140 may be positioned at front face 34 of frame 50. The amount of ink stored in ink chamber 101 may be detected optically or visually through translucent portion 140. Translucent portion 140 may be integrally formed with frame 50. Therefore, translucent portion 140 may comprise the same material as frame 50, i.e., translucent material, e.g., a transparent or semi-transparent resin material.

Translucent portion 140 may have a substantially rectangular parallelepiped shape. Translucent portion 140 may extend outwardly from a portion adjacent to a center of front face 34 of frame 50, and may comprise five walls having a substantially rectangular shape. An inner space may be formed therein, surrounded by the five walls. The inner space of translucent portion 140 may be in fluid communication with ink chamber 101.

When ink cartridge 100 is mounted to the image printing apparatus, translucent portion 140 may be positioned in an optical path of an optical sensor, e.g., a photo interrupter, positioned in the image printing apparatus. Side surfaces of translucent portion 140 may intersect the optical path. The side surface of translucent portion 140 may be irradiated with light, e.g., visible light or infrared light, emitted from the optical sensor.

Referring to FIG. 2, Pivotable member 70 may be positioned in ink chamber 101. Pivotable member 70 may comprise a resin material configured to impede light, e.g., prevent light from passing therethrough, or to alter the path of light. Referring to FIG. 2, pivotable member 70 may be supported by a shaft supporting rib 74 and supporting block 170, such that pivotable member 70 may pivot in the direction indicated by an arrow 44. Pivotable member 70 may comprise a float 73 positioned at one end of pivotable member 70. Float 73 may be configured to move up and down according to the amount of ink in ink chamber 101. Pivotable member 70 also may comprise an indicator portion 72, which may be positioned at another end of pivotable member 70 opposite the end at which float 73 may be positioned. Indicator portion 72 may be configured to be positioned in the inner space of translucent portion 140.

When float 73 moves up and down according to the amount of ink in ink chamber 101, pivotable member 70 may pivot in the direction indicated by arrow 44 in FIG. 2, and indicator portion 72 may move up and down in the inner space of translucent portion 140, according to the pivotal movement of pivotable member 70. More specifically, when ink cartridge 100 is mounted to the image printing apparatus, indicator portion 72 may move between a first position which intersects the optical path of the optical sensor and a second position which is offset from the optical path. By detecting the movement of indicator portion 72 moving up and down through translucent portion with the optical sensor, it may be determined whether ink chamber 101 has a sufficient amount of ink.

Referring to FIG. 3, air communication valve 80 may be positioned between translucent portion 140 and an end of front face 34 adjacent to upper face 36. Air communication valve 80 may be configured to open or close an opening 81 formed through front face 34 between translucent portion 140 and the end of front face 34 adjacent to upper face 36. Air communication valve 80 may comprise a valve body 87, a coil spring 86, a seal member 83, and a cap 85. Air communication valve 80 may close opening 81 with valve body 87. When ink cartridge 10 is mounted to the image printing apparatus, the image printing apparatus may press a rod 84 of valve body 87, and valve body 87 may move against an urging force of coil spring 86. The movement of valve body 87 against and urging force of coil spring 86 may open opening 81. Accordingly, ink chamber 101 and the exterior of ink cartridge 100 may be in fluid communication with each other, such that ink chamber 101 is brought into the same pressure as the atmospheric pressure. In another embodiment, instead of air communication valve 80, a closing means such as vinyl adhesive tape or a film may be used to close opening 81.

Referring to FIG. 2, ink supply valve 90 may be positioned between translucent portion 140 and an end of front face 34 adjacent to lower face 37. Ink supply valve 90 may be configured to open and close an opening 91 formed between translucent portion 140 and the end of front face 34 adjacent to lower face 37. Ink supply valve 90 may comprise a valve body 97, a coil spring 96, a spring seat 94, a seal member 93, and a cap 95. Ink supply valve 90 may normally close opening 91 with valve body 97 in a liquid-tight manner. When ink cartridge 10 is mounted to the image printing apparatus, valve body 97 may move against an urging force of coil spring 96 by a pipe (not shown) positioned in the image printing apparatus. The movement of valve body 97 may open opening 91. Accordingly, ink in ink chamber 101 may be supplied to the image printing apparatus via the ink supply valve 90.

Referring to FIGS. 1-4, shaft supporting rib 74 may be positioned at frame 50. Shaft supporting rib 74 may extend uprightly from an inclined portion 52 of frame 50 in ink chamber 101. Inclined portion 52 may define a portion of ink chamber 101 and may be positioned adjacent to a corner formed at front face 34 and lower face 37. Inclined portion 52 may be a portion of outer peripheral wall 51, and may be inclined with respect to front face 34 and lower face 37. In an embodiment, shaft supporting rib 74 may be positioned at an end of inclined portion 52 in width direction 31, e.g., at an end of inclined portion 52 at left side face 38.

Figure 4:
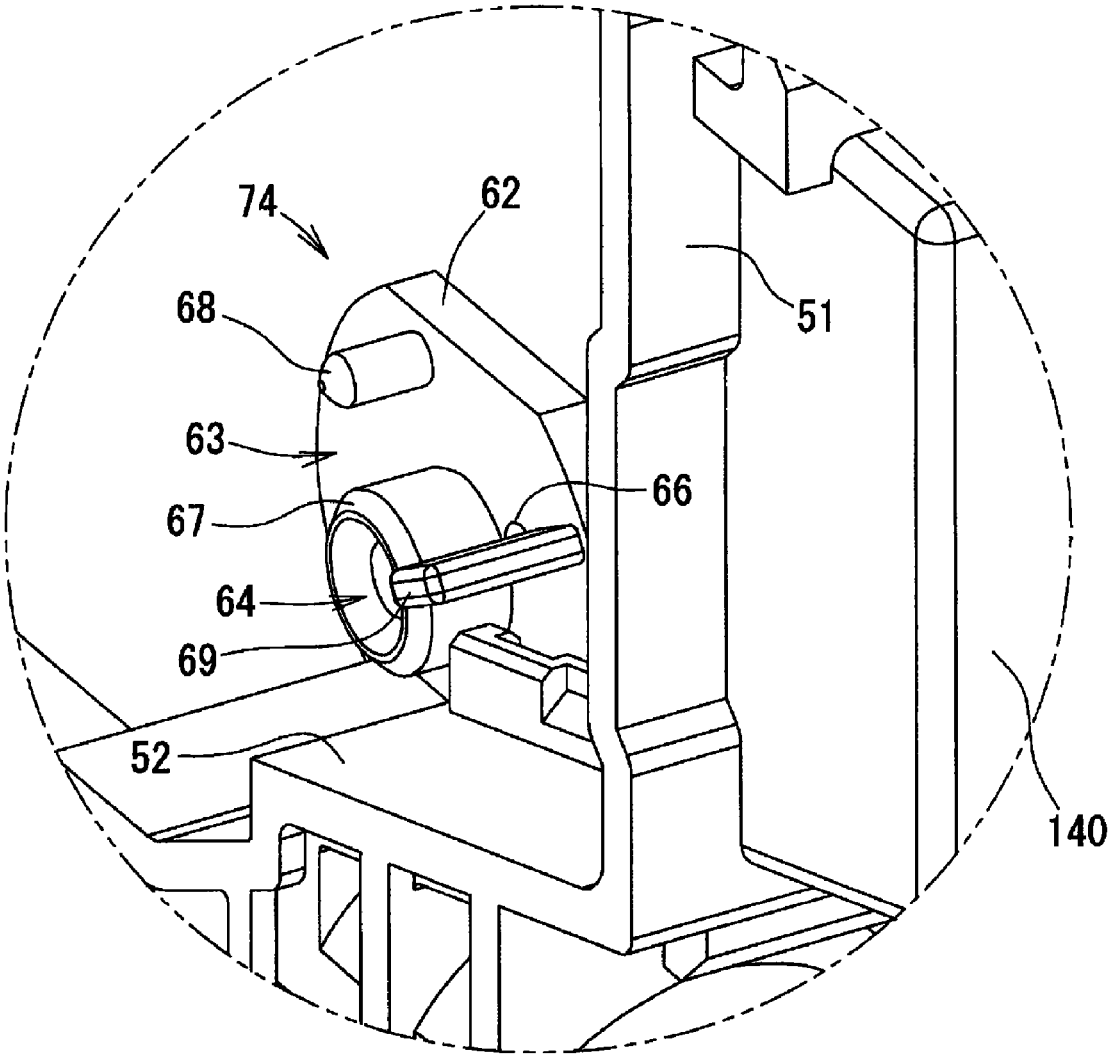
FIG. 4 is an enlarged perspective view of a shaft supporting rib of the ink cartridge according to an embodiment of the invention.

Shaft supporting rib 74 may be integrally formed with frame 50. Therefore, shaft supporting rib 74 may comprise the same material as the frame 50. A first end of a supporting shaft 77 may be supported by shaft supporting rib 74. Shaft supporting rib 74 also may support supporting block 170 and protecting member 150. Referring to FIG. 4, shaft supporting rib 74 may comprise a substantially disk-shaped base body 62, a shaft supporting portion 67, a projection 68, a stopper 69, and an opening 66. Each of shaft supporting portion 67, projection 68, and stopper 69 may be positioned on a surface 63 of base body 62 that may face right side face 39.

Referring to FIG. 4, shaft supporting portion 67 may be positioned at substantially the center of base body 62. Shaft supporting portion 67 may support the first end of supporting shaft 77. Supporting shaft 77 may be substantially column-shaped, and may be configured to pivotably support pivotable member 70. In an embodiment, the first end of supporting shaft 77 may be fixed to shaft supporting portion 67. Shaft supporting portion 67 may be a cylindrical boss extending from surface 63 of base body 62 in a direction perpendicular to surface 63. Shaft supporting portion 67 may have a shaft opening 64 formed therein, for receiving the first end of the supporting shaft 77.

The first end of supporting shaft 77 may be fitted into shaft opening 64. The diameter of shaft opening 64 may be less than the diameter of supporting shaft 77, and the first end of supporting shaft 77 may be press-fitted into shaft opening 64 of shaft supporting portion 67. Accordingly, the first end of supporting shaft 77 may be fixed to shaft supporting rib 74. A second end of supporting shaft 77 may be supported by supporting block 170. Supporting shaft 77, which may be fixed to shaft supporting portion 67, also may be inserted through a shaft opening 78 of pivotable member 70, such that pivotable member 70 is pivotably supported by supporting shaft 77.

Projection 68 may be positioned between shaft supporting portion 67 and upper face 36. Projection 68 may be configured to prevent pivotable member 70 from tilting in the axial direction of the supporting shaft 77, which corresponds to the width direction 31, when pivotable member 70 is supported by supporting shaft 77. The projection 68 may have a rod shape. The projection 68 may extend in a direction perpendicular to surface 63, which direction also corresponds to the axial direction of shaft opening 64, such that projection 68 extends toward pivotable member 70. The distal end of projection 68 may have a substantially spherical shape. Projection 68 may be positioned away from shaft supporting portion 67 in a direction perpendicular to the axial direction of shaft opening 64, and adjacent to an edge of base body 62. Projection 68 may extend the same distance from surface 63 as the distance that shaft supporting portion 67 extends from surface 63.

Stopper 69 may be positioned adjacent to shaft supporting portion 67. When supporting block 170 is attached to shaft supporting rib 74, stopper 69 may be configured to prevent the rotation of supporting block 170 with respect to supporting rib 74. Stopper 69 may have a substantially rod shape, and may extend from surface 63 in a direction perpendicular to surface 63.

Opening 66 may be formed at a position between stopper 69 and shaft supporting portion 67. Opening 66 may extend through base body 62. An end of an end portion 150B of protecting member 150 may be inserted into opening 66. A U-shaped portion 150A of protecting member 150 may be hooked on a hooking portion 131 formed on frame 50.

Figure 5:
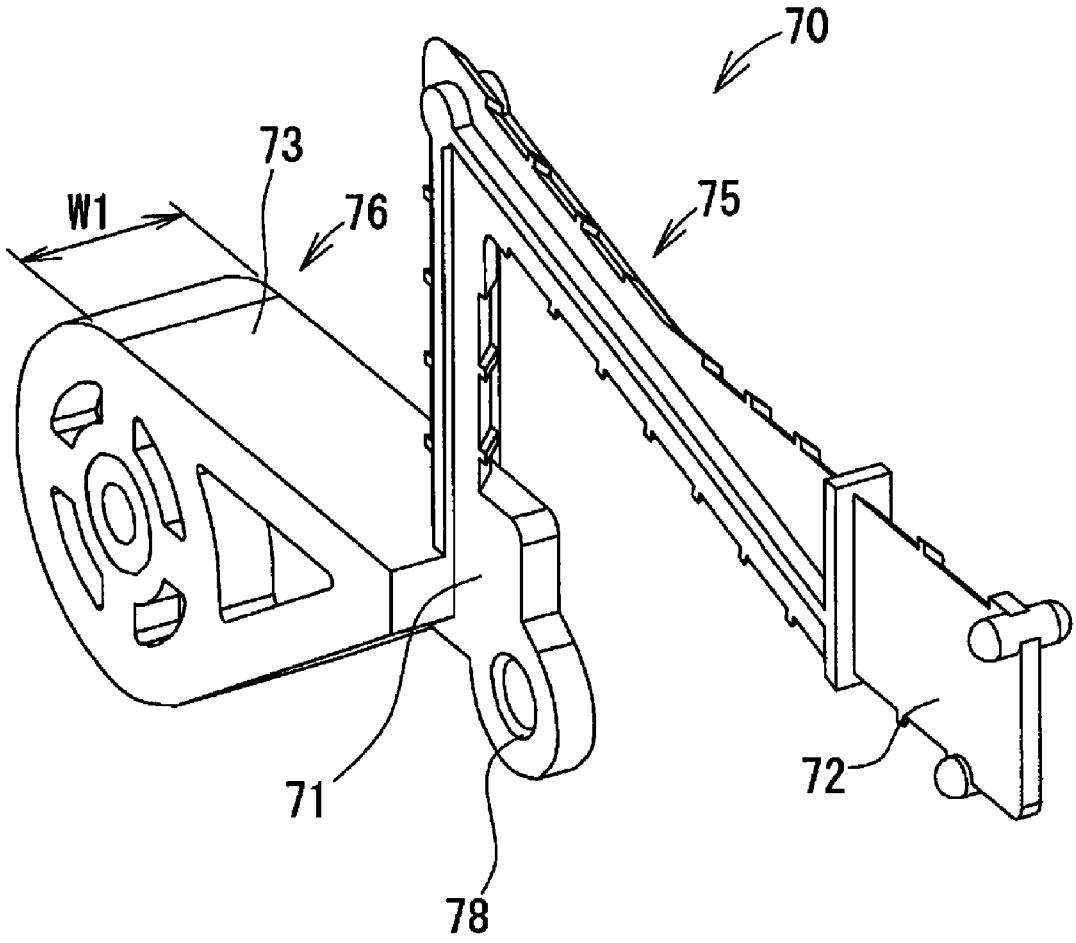
FIG. 5 is a perspective view of a pivotable member of the ink cartridge according to an embodiment of the invention.

FIGS. 2, 3, and 5 show a pivotable member 70 according to an embodiment of the invention. Pivotable member 70 may have shaft opening 78 formed therethrough at a position which corresponds to a center of the pivotal movement of pivotable member 70. Supporting shaft 77 may be inserted into shaft opening 78. Supporting shaft 77 may be configured to pivotably support pivotable member 70. The first end of supporting shaft 77 may be fixed to shaft supporting portion 67 of shaft supporting rib 74, and the second end of supporting shaft 77 may be fixed to a shaft supporting portion 185 of supporting block 170. The diameter of shaft opening 78 of pivotable member 70 may be greater than the diameter of supporting shaft 77, which may reduce a frictional force which may prevent the pivotal movement of pivotable member 70.

When pivotable member 70, supporting shaft 77, supporting rib 74, and supporting block 170 are separate members, supporting shaft 77 may be fixed while being tilted with respect to width direction 31. This tilting may be due to the accumulation of the dimensional tolerances of the respective members, or due the positional displacement of shaft supporting portions 67, 185. Thus, the diameter of shaft opening 78 of pivotable member 70 may be sufficiently greater than the diameter of supporting shaft 77 for smoothing the pivotal movement of pivotable member 70 in the direction indicated by arrow 44 in ink chamber 101. When the diameter of shaft opening 78 is greater than the diameter of supporting shaft 77, pivotable member 70 otherwise would be tilted in width direction 31. Nevertheless, shaft supporting rib 74 may comprise projection 68 and supporting block 170 may comprise projection 180. Projection 68 and projection 180 may prevent pivotable member 70 from tilting.

Figure 6:
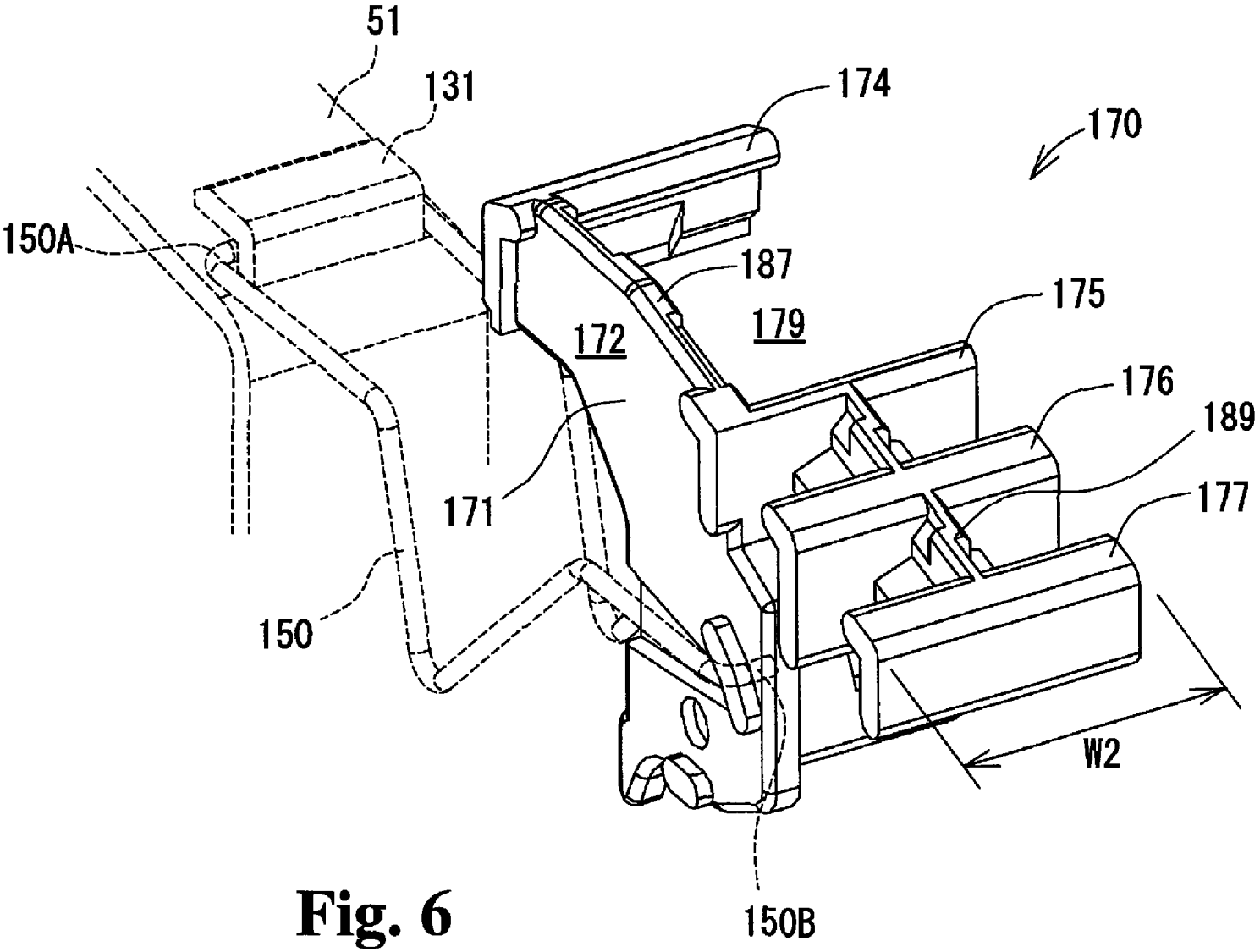
FIG. 6 is a perspective view of a supporting block of the ink cartridge according to an embodiment of the invention.

Referring to FIGS. 3 and 6, supporting block 170 may comprise the same material as frame 50, and may be positioned such that supporting block 170 opposes shaft supporting rib 74. Shaft supporting portion 185, which may be similar to shaft supporting portion 67, may be positioned on a surface of supporting block 170 facing right side face 39. Shaft supporting portion 185 may be configured to support the second end of supporting shaft 77.

Supporting shaft 77 may comprise metal, e.g., stainless steel, and may have a rod shape. The peripheral surface of supporting shaft 77 may be machined to have a smooth surface. Material other than stainless steel may be used as the material of supporting shaft 77. Supporting shaft 77, which may comprise a metal, may have a rigidity greater than that of frame 50, which may comprise synthetic resin.

Referring to FIG. 5, the specific gravity of float 73 may be less than the specific gravity of ink in ink chamber 101, such that float 73 may float on a surface of ink. Float 73 may have a hollow space therein, such that float 73 has the specific gravity less than that of ink, or alternatively float 73 may comprise material having a specific gravity less than that of ink. Thus, float 73 may move up and down in accordance with the amount of ink in ink chamber 101, and pivotable member 70 may pivot according to the movement of float 73.

Referring to FIG. 2, indicator portion 72 may indicate the amount of ink in ink chamber 101. When pivotable member 70 pivots clockwise in the direction shown by arrow 44 of FIG. 2, indicator portion 72 may enter the inner space of translucent portion 140, and indicator portion 72 then may contact an inner surface of a lower wall of translucent portion 140, such that further pivotal movement in the clockwise direction may be prevented. Accordingly, the pivotable member 70 may be positioned such that indicator portion 72 is at the first position. When pivotable member 70 pivots counterclockwise in the direction shown by arrow 44 of FIG. 2, indicator portion 72 may be positioned away from the inner surface of the lower wall of translucent portion 140 and may be positioned at the second position. The second position may be a position at which indicator portion 72 is a predetermined distance away from the inner surface of the lower wall of the translucent portion 140, and pivotable member 70 may stay at a position in which indicator portion 72 is at the second position.

Referring to FIG. 5, pivotable member 70 may have a thin-plate shape at a first portion 75 extending from shaft opening 78 to indicator portion 72. First portion 75 may be relatively thin in the axial direction of shaft opening 78. Consequently, the weight of pivotable member 70 may be reduced. A portion surrounding shaft opening 78 also may have a thin shape, similar to that of first portion 75. Therefore, the width of shaft opening 78 in the axial direction of shaft opening 78 may be the same width as that of first portion 75. Shaft supporting portions 67, 185 may be bosses being thick in width direction 31, respectively, and the width of shaft opening 78 may be thin, to reduce the width of ink cartridge 100. When the width of shaft opening 78 is thin, the friction resistance between pivotable member 70 and supporting shaft 77 may be reduced, but pivotable member 70 may be relatively more likely to tilt as described above.

Pivotable member 70 may comprise a planar portion 71. Planar portion 71 may have a pair of smooth planar surfaces on both sides in width direction 31. Planar portion 71 may be positioned between shaft opening 78 and float 73, and may have the same width in width direction 31 as first portion 75. Planar portion 71 may be at a position opposing projection 68, when pivotable member 70 is supported by supporting shaft 77. The planar surface of planar portion 71 has an area sufficiently greater than that of projection 68, such that the planar surface of planar portion 71 may be constantly opposed to projection 68 when pivotable member 70 pivots within the entire range of the pivotal movement of pivotable member 70.

The mass of a second portion 76 of pivotable member 70, which extends from shaft opening 78 to float 73, may be greater than the mass of first portion 75 of pivotable member 70. Thus, second portion 76 may be heavier than first portion 75 when pivotable member 70 is in air. Accordingly, when ink chamber 100 is substantially empty of ink, pivotable member 70 may pivot counterclockwise in the direction shown by arrow 44 of FIG. 2, about supporting shaft 77, such that indicator portion 72 may move away from the inner space of translucent portion 140. When the lower end of float 73 contacts the bottom surface of ink chamber 101, the pivotal movement of pivotable member 70 in the counterclockwise direction may stop, and indicator portion 72 may remain at the second position.

When ink chamber 101 has a predetermined amount or more of ink therein, e.g., when float 73 is submerged in ink, buoyancy may act on float 73, such that pivotable member 70 pivots clockwise about supporting shaft 77 in the direction shown by arrow 44 of FIG. 2. When this occurs, indicator portion 72 may enter the inner space of translucent portion 140, and may remain at the first position, in which the lower end of indicator portion 72 may contact the inner surface of the lower wall of translucent portion 140. When indicator portion 72 is in the inner space of translucent portion 140, indicator portion 72 may indicate that ink chamber 101 has the predetermined amount of ink, or more, therein.

It may be determined whether ink chamber 101 has the predetermined amount, or more, of ink therein by detecting the position of indicator portion 72 in the inner space of translucent portion 140 visually or optically by the optical sensor, e.g., a photo interrupter, via translucent portion 140.

FIGS. 3, 6 and 7(A)-7(D) describe a supporting block 170 according to an embodiment of the invention. In FIG. 6, a portion of outer peripheral wall 51 is depicted by a broken line for convenience of description. Supporting block 170 may be configured to support supporting shaft 77, and also may be configured to support film 65, which may be bent toward ink chamber 101. Supporting block 170 may be positioned in space 102, e.g., the lower portion of ink chamber 101, and may extend in width direction 31, below partitioning panel 53. In an embodiment, supporting block 170 may be configured to be removably mounted to shaft supporting rib 74 positioned at frame 50.

Referring to FIG. 6, supporting block 170 may comprise a plate 171, a plurality of ribs 174-177, shaft supporting portion 185, a stopper 178, and projection 180. These respective members may be integrally formed by molding the supporting block 170 by a synthetic resin. Supporting block 170 may be formed of the same material as the frame 50.

Referring to FIG. 6, rib 174 and rib 175 may extend from a second surface 173 of plate 171 in a direction perpendicular to second surface 173 of plate 171, e.g., in width direction 31. Each of rib 174 and rib 175 may have a substantially L-shape. Each of rib 174 and rib 175 may be positioned adjacent to an upper end 187 of plate 171. In an embodiment, rib 174 and rib 175 may be positioned a predetermined distance apart. Accordingly, an opening 179 may have a substantially C-shape when viewed in plan view. Plate 171 may be formed between rib 174 and rib 175. In an embodiment, first portion 75 of pivotable member 70 may be positioned in opening 179, and pivotable member 70 may pivot within the range of opening 179. Accordingly, when supporting block 170 is positioned in space 102, pivotable member 70 may move pivotally.

Supporting block 170 may comprise a supporting portion 189 extending substantially in depth direction 33 from rib 175. Supporting portion 189 may extend from substantially the widthwise center portion of rib 175 in a direction away from rib 174. Rib 176 and rib 177 may be positioned at supporting portion 189. Rib 176 and rib 177 may be positioned a predetermined distance apart. Therefore, ribs 174-177 may be scattered over space 102.

Figure 7D:
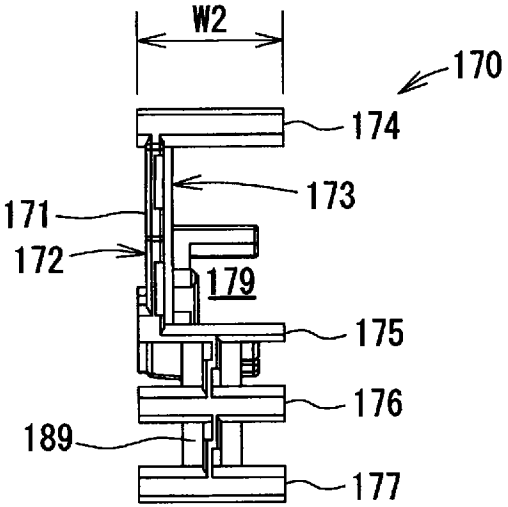
FIG. 7(D) is a plane view, of the supporting block of FIG. 6.

Referring to FIGS. 6 and 7(D), each of rib 176 and rib 177 may have a substantially L-shape, and rib 176 and 177 may be substantially the same shape as rib 174 and rib 175, respectively. In an embodiment, each of rib 176 and rib 177 may extend from supporting portion 189 in width direction 31, toward both left side face 38 and right side face 39 by the same distance. Each of ribs 174-177 may have a width W2 in width direction 31. Width W2 may be sufficient to prevent films 65 from contacting pivotable member 70 even when films 65 are bent toward ink chamber 101. More specifically, width W2 may be greater than a width W1 of float 73 of pivotable member 70. In an embodiment, width W2 may be substantially the same as the width of frame 50.

Figure 7C:
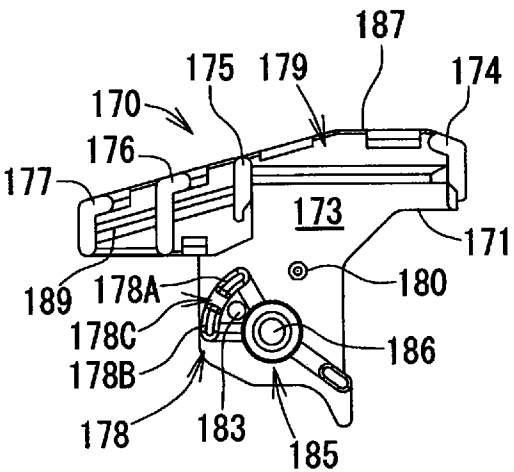
FIG. 7(C) is a right side view of the supporting block of FIG. 6.
Figure 7A:
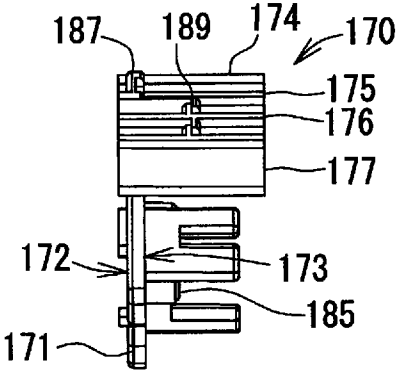
FIG. 7(A) is a front view of the supporting block of FIG. 6.
Figure 7B:
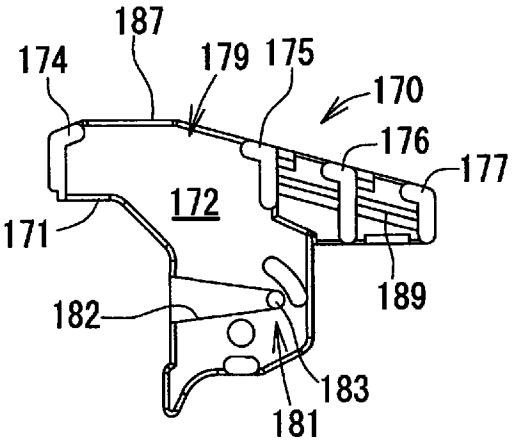
FIG. 7(B) is a left side view of the supporting block of FIG. 6.

Referring to FIG. 7(B), a groove 182 may be formed in a lower portion of a first surface 172 of plate 171. Groove 182 may have a substantially triangle shape, and may be oriented sideward. Referring to FIGS. 7(B) and 7(C), an opening 183 may be formed through plate 171 at an apex 181 of groove 182. When an end of end portion 150B of protecting member 150 is pushed toward apex 181 along groove 182 while supporting block 170 is positioned in space 102, the end of end portion 150B may be guided toward apex 181. An operation to insert the end of end portion 150B of protecting member 150 into opening 183 may be facilitated, and the end of end portion 150B may be inserted into opening 183.

Stopper 178 may be positioned at second surface 173 of plate 171. Stopper 178 may be positioned at a position that corresponds to stopper 69 of shaft supporting rib 74. Referring to FIG. 7(C), stopper 178 may comprise two rod-shaped ribs 178A, 178B extending from second surface 173 of plate 171 in a direction perpendicular to second surface 173. Rib 178A and rib 178B may be positioned a predetermined distance apart. When supporting block 170 is mounted to shaft supporting rib 74, stopper 69 of shaft supporting rib 74 may be inserted into a gap 178C between rib 178A and rib 178B.

Referring to FIG. 7(C), projection 180 may be positioned above shaft supporting portion 185, at a position opposing projection 68 of shaft supporting rib 74. Projection 180 may have a shape similar to projection 68, and may be configured to prevent pivotable member 70 from tilting in the axial direction of supporting shaft 77, which corresponds to width direction 31, when pivotable member 70 is supported by supporting shaft 77. Projection 180 may have a substantially rod shape and may extend from second surface 173 in a direction perpendicular to second surface 173. Projection 180 may extend toward pivotable member 70 when pivotable member 70 is supported by supporting shaft 77. The distal end of projection 180 may have a substantially spherical shape. Projection 180 may extend the same distance from second surface 173 as the distance that shaft supporting portion 185 extends from second surface 173.

Shaft supporting portion 185 may be positioned at second surface 173 of plate 171, and the second end of supporting shaft 77 may be press-fitted into shaft supporting portion 185. Shaft supporting portion 185 may be a cylindrical boss extending from second surface 173 in a direction perpendicular to second surface 173 and may have a shaft opening 186 formed therein, into which the second end of supporting shaft 77 may be press-fitted.

Supporting block 170 may be mounted to shaft supporting rib 74 in a manner set forth herein. The first end of supporting shaft 77 may be press-fitted into shaft supporting portion 67 of shaft supporting rib 74. Then, supporting shaft 77 may be inserted through shaft opening of pivotable member 70. Subsequently, supporting block 170 may be positioned such that second surface 173 may face shaft supporting rib 74 while shaft supporting portion 185 is aligned with the second end of supporting shaft 77. Moreover, gap 178C of stopper 178 may be aligned with stopper 69. Then, supporting block 170 may be pushed toward shaft supporting rib 74. When this occurs, the second end of supporting shaft 77 may be press-fitted into shaft supporting portion 185. Accordingly, supporting shaft 77 may extend between film 65 on left side face 38 and film 65 on right side face 39. Stopper 69 may be inserted into gap 178C of stopper 178. Accordingly, supporting block 170 may be restricted from rotating with respect to shaft supporting rib 74. As such, pivotable member 70 may be pivotably supported by supporting shaft 77 while first portion 75 of pivotable member 70 is positioned in opening 179. When supporting block 170 is mounted to frame 50, ribs 174-177 may extend substantially perpendicularly to film 65 on left side face 38 and to film 65 on right side face 39.

Figure 8:
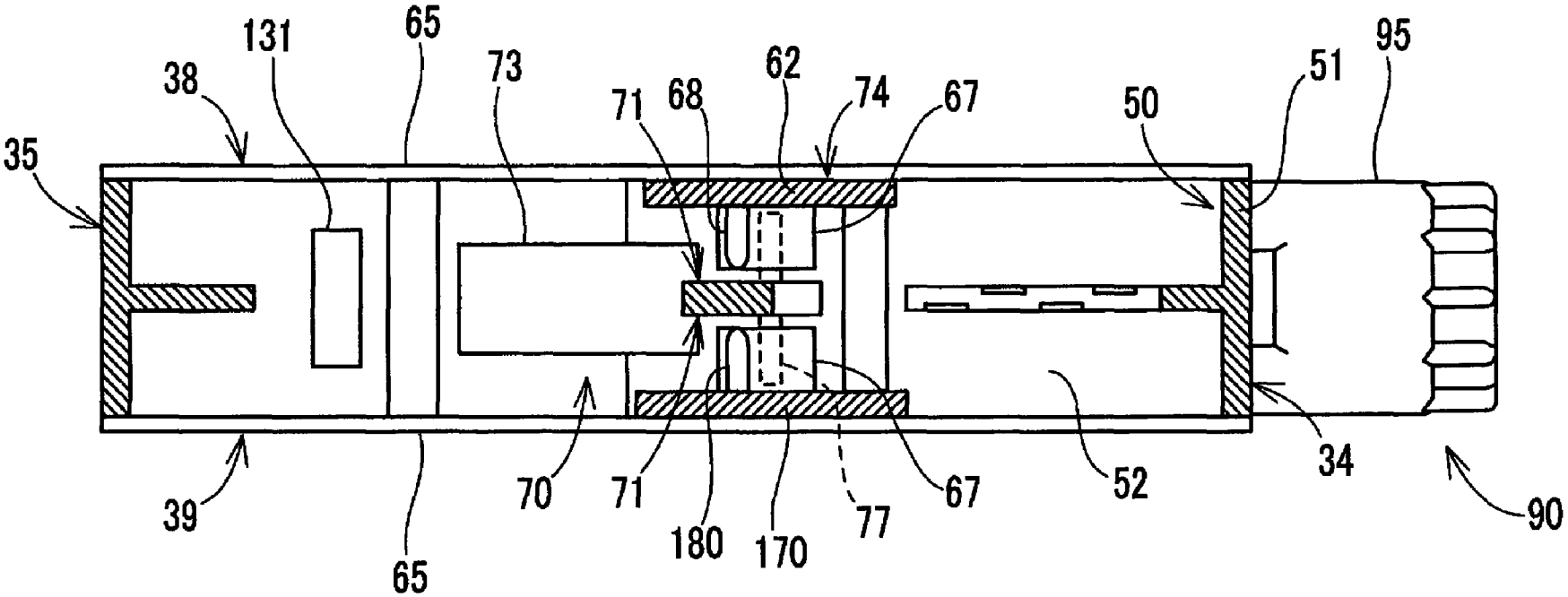
FIG. 8 is a cross-sectional view taken along line VIII-VIII in FIG. 2.

As described above, in an embodiment, projection 68 may be positioned at shaft supporting rib 74, and projection 180 may be positioned at supporting block 170. Referring to FIG. 8, projections 68 and 180 may extend toward pivotable member 70. If a force attempts to tilt pivotable member 70 in the axial direction of supporting shaft 77, which corresponds to width direction 31, pivotable member 70 may be supported by projections 68, 180. Therefore, the tilt of pivotable member 70 may be prevented, and pivotable member 70 may be prevented from contacting films 65 due to a force attempting to tilt pivotable member 70. Although in an embodiment, projections 68 and 180 are positioned at both shaft supporting rib 74 and supporting block 170, in another embodiment, a projection may be positioned at one of shaft supporting rib 74 and supporting block 170, or both. In another embodiment in which a projection is positioned at one of shaft supporting rib 74 and supporting block 170, and is not positioned at the other of shaft supporting rib 74 and supporting block 170, the tilting of pivotable member 70 may be reduced or prevented at least in one direction.

Referring to FIGS. 5 and 8, pivotable member 70 may comprise planar portion 71 which may oppose respective projections 68 and 180. Therefore, when a force attempts to tilt pivotable member 70, planar portion 71 may contact projections 68 or 180. Because the surfaces of planar portion 71 may be smooth, pivotable member 70 may be free to pivot while planar portion 71 contacts projection 68 or projection 180, because projections 68 or 180 may slide on planar portion 71. Thus, the pivotal movement of pivotable member 70 may not be hindered.

Because each of the distal end of projections 68 and 180 may have a substantially spherical shape, even when planar portion 71 contacts projections 68 or 180, the pivotal movement of pivotable member 70 may be smooth because the frictional resistance between the spherical end of projections 68 or 180 and planar portion 71 may be low.

Because projection 68 is positioned away from shaft supporting portion 67 in a direction perpendicular to the axial direction of shaft opening 64, and adjacent to an edge of base body 62, even when the tilting angle of pivotable member 70 is small, pivotable member 70 may be supported by projection 68. Accordingly, even a slight tilting of pivotable member 70 may be prevented.

In an embodiment, supporting shaft 77 may be supported by shaft supporting rib 74 and supporting block 170 which may be separate members. Nevertheless, in another embodiment, both ends of supporting shaft 77 may be supported by a single member.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case having an ink chamber defined therein;

a pivotable member positioned in the ink chamber, wherein the pivotable member has an opening formed therethrough, and the pivotable member is configured to pivot about the opening of the pivotable member;

a supporting shaft comprising a first end and a second end opposite the first end, wherein the supporting shaft is positioned within the opening of the pivotable member;

a supporting member configured to support at least one of the first end and the second end of the supporting shaft; and a projection extending from the supporting member toward the pivotable member.

2. The ink cartridge of claim 1, wherein the supporting member comprises a first member configured to support the first end of the supporting shaft, and a second member configured to support the second end of the supporting shaft, wherein the first member is integrally formed with the case, and the second member is removably mounted to the first member.

3. The ink cartridge of claim 2, wherein the first member comprises a first supporting portion, and the second member comprises a second supporting portion, and wherein the first end of the supporting shaft is fitted into the first supporting portion, and the second end of the supporting shaft is fitted into the second supporting portion.

4. The ink cartridge of claim 2, wherein the projection extends from at least one of the first member and the second member.

5. The ink cartridge of claim 1, wherein the supporting member comprises a synthetic resin, and the supporting shaft comprises a metal.

6. The ink cartridge of claim 1, wherein each of the first end and the second end of the supporting shaft is fixed to the supporting member, and the pivotable member is pivotably supported by the supporting shaft.

7. The ink cartridge of claim 1, wherein the pivotable member comprises a planar portion, and the planar portion comprises a planar surface which extends in a direction perpendicular to an axial direction of the opening of the pivotable member, and the planar surface is positioned opposite to the projection.

8. The ink cartridge of claim 7, wherein a distal end of the projection has a substantially spherical shape.

9. The ink cartridge of claim 1, wherein the supporting shaft is supported by the supporting member at a supporting position, and the projection is separated from the supporting position in a direction perpendicular to an axial direction of the supporting shaft.

10. The ink cartridge of claim 1, wherein the projection extends in an axial direction of the supporting shaft.

11. The ink cartridge of claim 1, wherein the case comprises a first wall and a second wall opposite the first wall, and the first wall and a second wall at least partially define the ink chamber therebetween, and the supporting shaft extends between the first wall and the second wall.

12. The ink cartridge of claim 11, wherein at least one of the first wall and the second wall comprise a film covering an opening formed at a face of the case.

13. The ink cartridge of claim 1, wherein the pivotable member comprises a first end and a second end opposite the first end of the pivotable member, wherein the first end of the pivotable member is configured to move between a first position and a second position separate from the first position, and wherein the pivotable member comprises a float positioned at the second end of the pivotable member, and the float is configured to move relative to an amount of ink stored in the ink chamber.

14. The ink cartridge of claim 13, wherein the case comprises a translucent portion having an inner space configured to be in fluid communication with the ink chamber, and wherein at least when the first end of the pivotable member is at the first position, the first end of the pivotable member is positioned in the inner space of the translucent portion.

* * * * *